US006292100B1

(12) United States Patent
Dowling

(10) Patent No.: US 6,292,100 B1
(45) Date of Patent: Sep. 18, 2001

(54) DOOR WARNING SYSTEM

(75) Inventor: David Lawrence Dowling, North Ryde (AU)

(73) Assignee: D2 Technologies Pty Ltd., North Ryde (AU)

( * ) Notice: Subject to any disclaimer, the term of this patent is extended or adjusted under 35 U.S.C. 154(b) by 0 days.

(21) Appl. No.: 09/528,671

(22) Filed: Mar. 20, 2000

(51) Int. Cl.[7] ..... G08B 13/08

(52) U.S. Cl. ..... 340/545.6; 340/545.1; 340/545.2; 340/545.3

(58) Field of Search ..... 340/545.5, 545.1, 340/545.2, 545.3, 556, 545.6

(56) References Cited

U.S. PATENT DOCUMENTS 3,560,950 * 2/1971 Peters ..... 340/258
4,698,937 * 10/1987 Kornbrekke et al. ..... 49/25
5,142,152 * 8/1992 Boiucaner ..... 250/341
5,153,560 * 10/1992 Ichikawa ..... 340/522
5,745,035 * 4/1998 Deyo ..... 340/541
5,819,124 * 10/1998 Somner et al. ..... 396/263
5,861,806 * 1/1999 Vories et al. ..... 340/555

* cited by examiner

*Primary Examiner*—Jeffery Hofsass
*Assistant Examiner*—Son Tang
(74) *Attorney, Agent, or Firm*—Cohen, Pontani, Lieberman & Pavane

(57) ABSTRACT

A door warning system comprising a sensor adapted to sense the presence of persons immediately adjacent a first side of a swinging door; an audio or visual alarm responsive to the sensor adapted to advise a person on a second side of the door being opposite the first side of the presence of a person on the first side of the door.

14 Claims, 1 Drawing Sheet

DOOR WARNING SYSTEM

Figure 1:
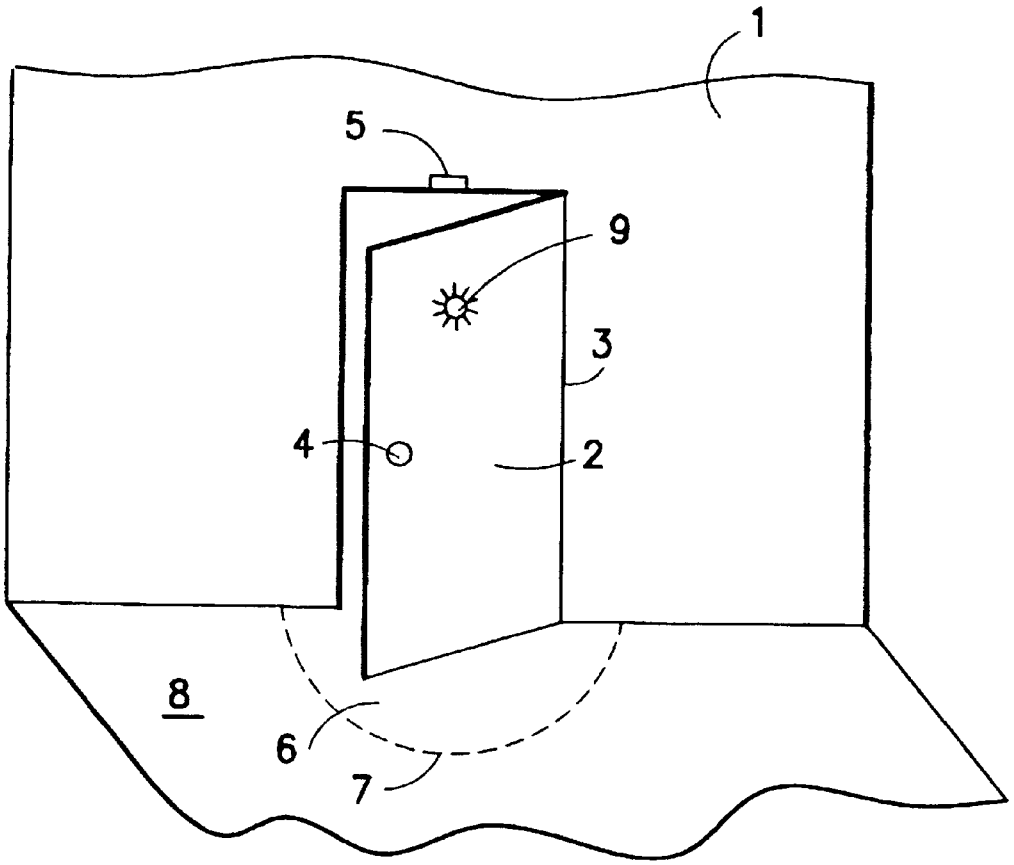

The present invention relates to a door warning system and in particular to a system adapted to warn a person approaching a door of the presence of a person on the other side of that door.

For many years doors have caused injuries to persons and damage to objects due to the fact that most doors are not provided with windows and consequently a person about to operate a door from one side cannot determine whether or not a person is on the other side of the door. In situations where a door opens outwardly into an area into which vision is not possible with the door closed there is always the potential that the opening of the door may strike a person on the other side of the door or cause them to drop articles which they may be carrying. The situation is particularly difficult in the case where a door is opened quickly or where a door is capable of swinging into a room or area either side of its jamb. The potential for damage, inconvenience and property damage is further exacerbated when the area into which the door opens is small or lies adjacent a busy work area. Restaurant kitchens are particularly hazardous in this regard.

It is not always practicable to place a window in a door in order that person about to open a door may observe activity on the other side of the door as privacy may be required on one or both of the two sides of the door. In the case where doors are opened quickly it may furthermore be the case that a small window in a door would not be adequate in order that traffic in the area adjacent the other side of the door may be fully observed and assessed particularly if the person requiring to open the door is in a hurry.

It is accordingly an object of the present invention to ameliorate one or more of the above difficulties associated with doors or at least to provide an alternative to existing systems designed to facilitate safe operation of doors.

According to the present invention there is disclosed a door warning system comprising a sensor adapted to sense the presence of persons immediately adjacent a first side of a swinging door; alarm means responsive to the sensor means adapted to advise a person on a second side of the door being opposite the first side of the presence of a person on the first side of the door.

One embodiment of the present invention will now be described with reference to the accompanying drawing being a perspective view of a door fitted with a system in accordance with the present invention.

According to the embodiment of FIG. 1 there is disclosed a wall 1 into which is set a swinging door 2 hinged along side 3 and openable by way of a conventional handle 4.

Above the door there is provided a radar sensing unit 5 adapted to project a sensing beam downwardly into an area roughly corresponding to the semi-circle 6 defined by dotted line 7 and being slightly larger than the arc through which the door swings when projected onto the floor 8.

Sensor 5 is adapted to trigger an alarm condition in indicator 9 when the presence of a person in area 6 is detected.

It is important that indicator 9 communicates this alarm condition to persons on the opposite side of door 2 to that depicted in FIG. 1 in order that persons approaching the door from the opposite side (not shown) may be aware that opening the door may cause the door to hit persons in area 6. The indicator may take any known form such as a light or audible indication.

If door 2 is capable of swinging not only into area 6 but also into the corresponding area (not shown) on the opposite side of wall 1 then the opposite side of the door may similarly be provided with a sensor projected into an area immediately adjacent the door on that side in order to provide an indication to persons in area 6 wishing to open the door by pushing the door whilst standing adjacent area 6.

It is of course important that sensor 5 be adequately focused into area 6. The area into which the sensor maybe focused will be able to be determined by any persons skilled in the art of focusing infra-red or radar-type units. Even pressure pads located in the floor may be utilised as sensors. If the sensing area is too broad then persons may ignore the alarm conditions displayed by the indicator whereas if the sensing area is too small accidents may still occur despite the absence of an alarm indication.

The indicator need not necessarily be on the door and may be located at a position on a wall adjacent a door and a simple system of red light green light indicators on either side of the door may be useful having regard to the known meanings for red lights and green lights associated with motor traffic signals.

More elaborate systems may be devised apart from that above disclosed in order to control a door and for example the presence of a person in a sensing area may cause a door to lock or to be openable only against a severe damper in order to prevent fast opening of the door.

A door may also be provided with a system to determine the priority between two persons wishing to use the door with one person located on either side of the door. The system could ensure that the first person in a sensing area had priority. A red light-green light system would be appropriate in respect of the lastmentioned situation and the first person approaching the door would receive a green light indicator whereas the person on the opposite side of the door who may arrive only milliseconds later may receive a red light indication indicating that the door is about to be opened from the other side.

Naturally the sensing systems associated with the present invention are required to be in communication with a power source. Although battery or mains power may be utilised in connection with a system in accordance with the present invention there are disadvantages with each said alternative. Firstly mains power requires unsightly wiring or alterations to the wiring of a premises which may well require an electrician. Battery power sources are expensive in the long run due to the need to replace batteries and unreliable to the extent that batteries may fail at inopportune times when replacement batteries are not readily available.

In order to overcome the lastmentioned difficulties with known power sources a further aspect of the present invention discloses a door closing device of the type which are well known and which utilise biasing means to return a door to a closed position after opening in a controlled manner under the influence of a dampner. In accordance with the present invention either the energy involved in opening a door or the otherwise wasted energy controlled by the dampner when a door is slowly closing under the influence of the biasing means are utilised in order to drive a power generating device in communication with a storage battery. Alternatively hot sources of energy may be utilised. The storage battery may then be utilised to power the sensors, lights or alarms associated with the other aspects of the present invention.

It will be appreciated that mass production of the components of a system in accordance with the present invention will facilitate economic installation of such systems and it is envisaged that a single unit placed above a door may contain both the alarm indicator and a sensor to determine the presence of persons on at least one side of a door.

Alternate embodiments of this invention may be devised apart from those above described and it is intended by the applicant that all such systems should be encompassed within the scope and intendment of this Patent application.

The claims defining the present invention are as follows:

1. A door warning system, comprising:

a sensor adapted to sense the presence of persons immediately adjacent a first side of a swinging door;

alarm means responsive to the sensor means adapted to advise a person on a second side of the door being opposite the first side of the presence of a person on the first side of the door; and wherein the door associated with the system is provided with link mean attached to an electrical power generating means adapted to convert one of the opening and closing motion of the door into an appropriate form to drive the electrical power generating means, the electrical power generating means in turn being in communication with a storage battery which powers the sensor and alarm means.

2. A door warning system in accordance with claim 1 hereof wherein the sensor is adapted to scan an area adjacent the floor through which a door may swing plus no more than a further meter past such door path.

3. A door warning system in accordance with claim 1 hereof wherein a radar sensing unit is utilized.

4. A door warning system in accordance with claim 1 hereof wherein an infra-red sensing unit is utilized.

5. A door warning system in accordance with claim 1 hereof wherein the alarm means comprises a light visible to a person approaching a door indicating red in the case where a person is present on the other side of the door and green when a person is not.

6. A door warning system in accordance with claim 1 hereof wherein the alarm means comprises an audio output.

7. A door warning system in accordance with claim 1 hereof wherein there are sensing units and alarm means on each side of the approach to the door in order that persons on either side of the door may be appraised of the status of the area on the opposite side of the door.

8. A door warning system, comprising:

a sensor adapted to sense the presence of persons immediately adjacent a first side of a swinging door;

alarm means responsive to the sensor means adapted to advise a person on a second side of the door being opposite the first side of the presence of a person on the first side of the door; and wherein the door associated with the system is provided with link means attached to an electrical power generating means adapted to convert the opening motion of the door into an appropriate form to drive the electrical power generating means, the electrical power generating means in turn being in communication with a storage battery which powers the sensor and alarm means; and biasing means adapted to close the door with the electrical power generating means being used to damp the closing of the door under the influence of the biasing means.

9. A door warning system in accordance with claim 8 hereof wherein the sensor is adapted to scan an area adjacent the floor through which a door may swing plus no more than a further meter past such door path.

10. A door warning system in accordance with claim 8 hereof wherein a radar sensing unit is utilized.

11. A door warning system in accordance with claim 8 hereof wherein an infra-red sensing unit is utilized.

12. A door warning system in accordance with claim 8 hereof wherein the alarm means comprises a light visible to a person approaching a door indicating red in the case where a person is present on the other side of the door and green when a person is not.

13. A door warning system in accordance with claim 8 hereof wherein the alarm means comprises an audio output.

14. A door warning system in accordance with claim 8 hereof wherein there are sensing units and alarm means on each side of the approach to the door in order that persons on either side of the door may be appraised of the status of the area on the opposite side of the door.

* * * * *